US006609789B1

(12) United States Patent
Hunt

(10) Patent No.: US 6,609,789 B1
(45) Date of Patent: Aug. 26, 2003

(54) INK CARTRIDGE

(75) Inventor: David W. Hunt, Cedar Hill, TX (US)

(73) Assignee: BancTec, Inc., Irving, TX (US)

( * ) Notice: Subject to any disclaimer, the term of this patent is extended or adjusted under 35 U.S.C. 154(b) by 22 days.

(21) Appl. No.: 10/093,532

(22) Filed: Mar. 11, 2002

(51) Int. Cl.[7] ..... B41J 2/175
(52) U.S. Cl. ..... 347/86
(58) Field of Search ..... 347/85, 86, 87; 222/92, 100, 107

(56) References Cited

U.S. PATENT DOCUMENTS

| | | | | |
|---|---|---|---|---|
| D141,987 | S | | 8/1945 | Silston |
| 4,131,899 | A | | 12/1978 | Christou |
| 4,447,820 | A | | 5/1984 | Terasawa |
| 4,553,971 | A | | 11/1985 | Ashley, Robert J. et al. |
| 4,577,203 | A | | 3/1986 | Kawamura |
| 4,673,955 | A | | 6/1987 | Ameyama et al. |
| 4,759,472 | A | | 7/1988 | Strenger |
| D318,795 | S | | 8/1991 | Christine |
| D341,157 | S | | 11/1993 | Kitahara et al. |
| 5,307,091 | A | | 4/1994 | DeCoste, Jr. |
| 5,574,489 | A | | 11/1996 | Cowger et al. |
| D378,660 | S | | 4/1997 | Ota et al. |
| 5,666,146 | A | | 9/1997 | Mochizuki et al. |
| 5,691,755 | A | | 11/1997 | Pawlowski, Jr. et al. |
| D387,087 | S | | 12/1997 | Sasaki |
| 5,699,936 | A | | 12/1997 | Sakamoto |
| D392,995 | S | | 3/1998 | Sasaki |
| 5,896,151 | A | * | 4/1999 | Miyazawa et al. ..... 347/86 |
| 6,053,606 | A | | 4/2000 | Yamaguchi et al. |
| 6,106,112 | A | | 8/2000 | Okubo et al. |
| D437,350 | S | | 2/2001 | Hsu |
| D444,814 | S | | 7/2001 | Hunt |
| 6,264,314 | B1 | | 7/2001 | Mochizuki et al. |

FOREIGN PATENT DOCUMENTS

| | | | | |
|---|---|---|---|---|
| JP | 59-204566 | * | 11/1984 | ..... B41J/3/04 |
| JP | 08-230204 | * | 9/1996 | ..... B41J/2/175 |

* cited by examiner

*Primary Examiner*—Anh T. N. Vo
(74) *Attorney, Agent, or Firm*—Locke Liddell & Sapp LLP

(57) ABSTRACT

An ink cartridge includes an ink bag for containing ink. The bag is sealed along the bottom to form a bottom seam and is sealed along the bag sides to form side seams. The cartridge includes a housing having first and second side walls defining a cavity for receiving the bag. A first compressible foam sheet is disposed in the cavity between one of the side walls of the housing and one of the walls of the bag and adjacent the side seams. A second compressible foam sheet is disposed in the cavity between the other side wall of the housing and the other bag wall and adjacent the side seams. The foam sheets supply a uniform distribution of pressure along the side seams of the bag as ink is withdrawn from the bag and expand to assist in the uniform delivery of ink from the bag.

19 Claims, 6 Drawing Sheets

INK CARTRIDGE

TECHNICAL FIELD OF THE INVENTION

The present invention relates to containers for liquids, and more particularly to an ink cartridge for maintaining uniform pressure on an ink bag and for assisting in the dispensing of ink from the bag.

BACKGROUND OF THE INVENTION

Ink jet printers utilize ink cartridges for storing and delivery of ink to a print head. Cartridges typically include an ink bag having walls made of a flexible sheet material. The sheet material is sealed such that the bag includes multiple seams. Excess stress on portions of the bag seams may cause a seam to rupture resulting in ink leaking from the bag and cartridge.

A need has thus arisen for an ink cartridge which evenly distributes the stress placed on seams of the ink bag to thereby reduce the risk of seam failure. A need has also arisen for an ink cartridge which generates a consistent amount of force on the ink during usage, especially when the bag ink supply within the cartridge becomes low.

SUMMARY OF THE INVENTION

In accordance with the present invention, an ink cartridge includes an ink bag for containing ink. The bag side walls are sealed together along the bottom to form a bottom seam and are sealed together along the bag sides to form side seams. The cartridge includes a housing having first and second side walls defining a cavity for receiving the bag. A first compressible foam sheet is disposed in the cavity between one of the side walls of the housing and one of the walls of the bag and adjacent the side seams. A second compressible foam sheet is disposed in the cavity between the other side wall of the housing and the other bag wall and adjacent the side seams. The foam sheets supply a uniform distribution of pressure along the side seams of the bag as ink is withdrawn from the bag and expand to assist in the uniform delivery of ink from the bag.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
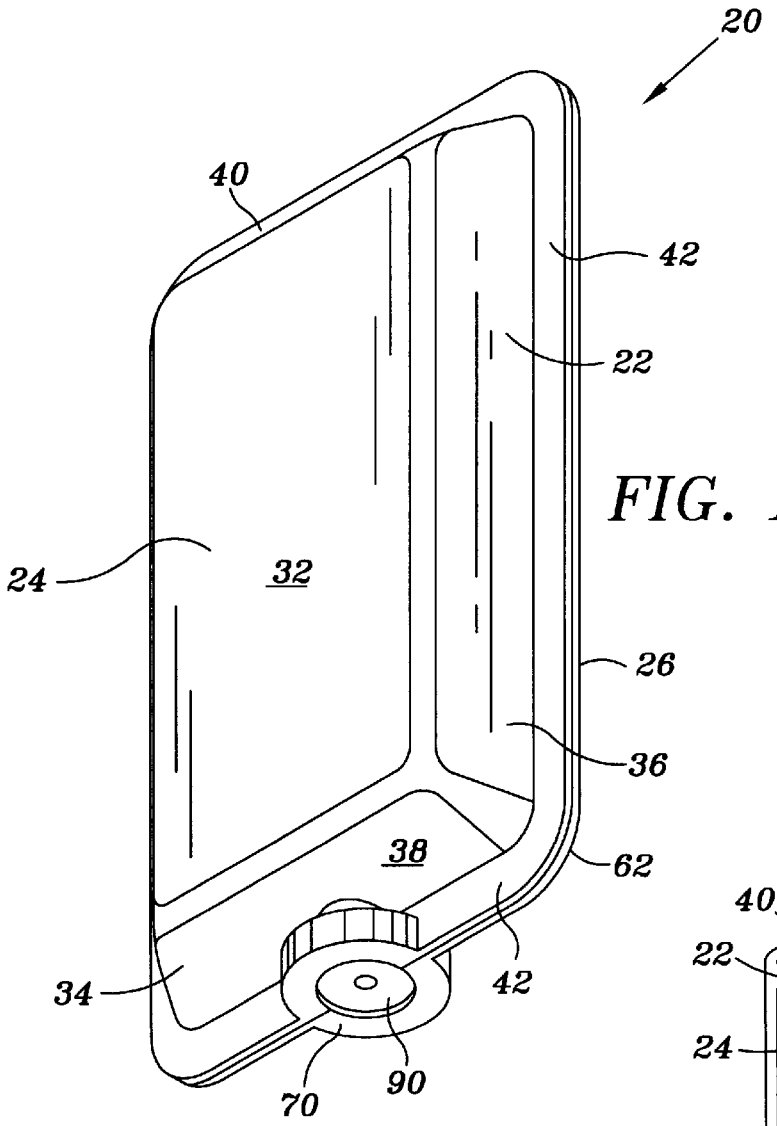
FIG. 1 is a perspective view of the present ink cartridge.
Figure 2:
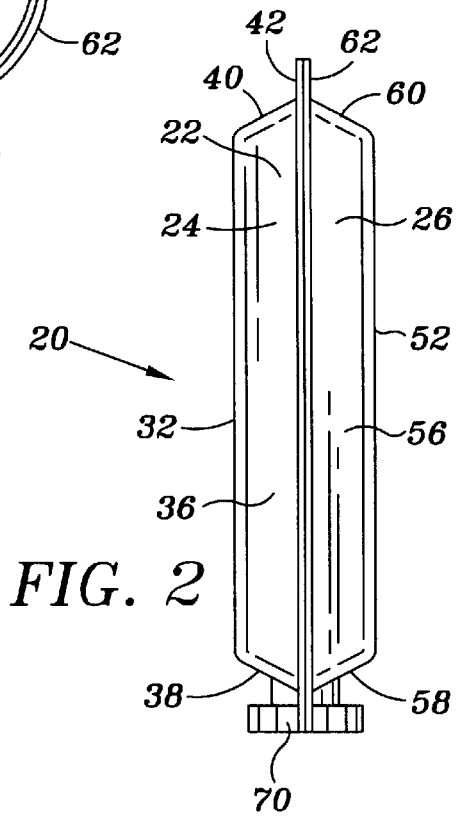
FIG. 2 is a right side elevational view thereof.
Figure 3:
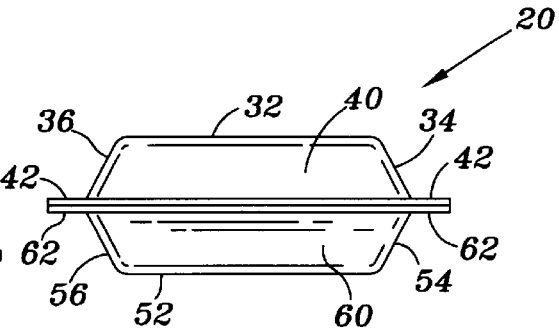
FIG. 3 is a bottom plan view thereof.
Figure 4:
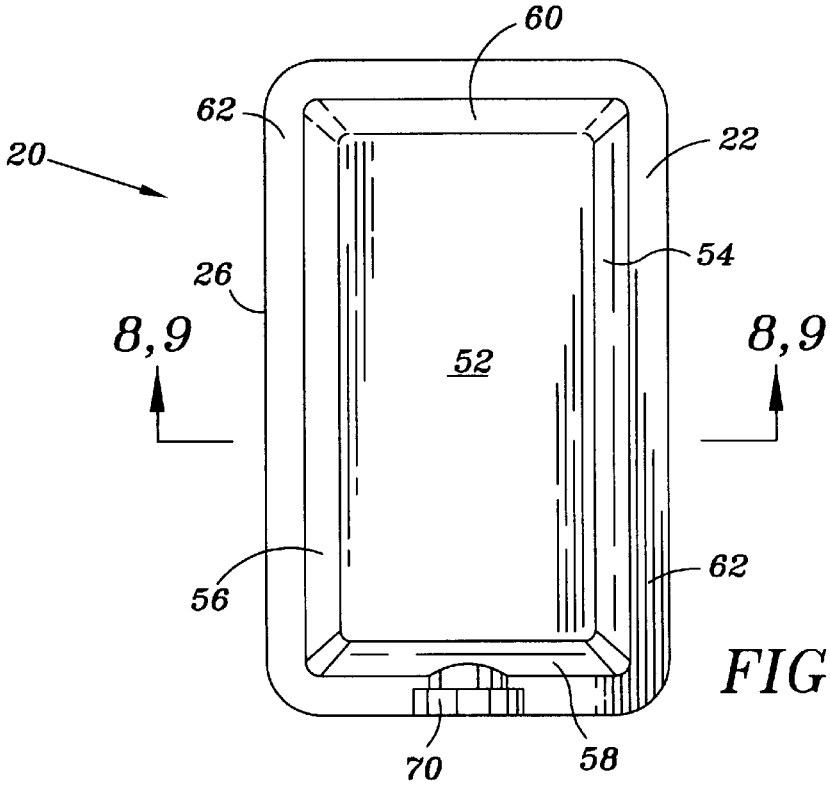
FIG. 4 is a front elevational view thereof.
Figure 5:
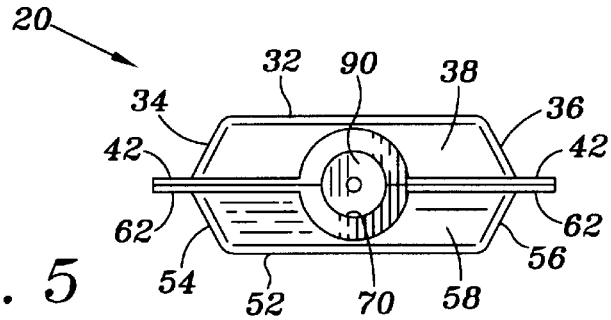
FIG. 5 is a top plan view thereof.
Figure 6:
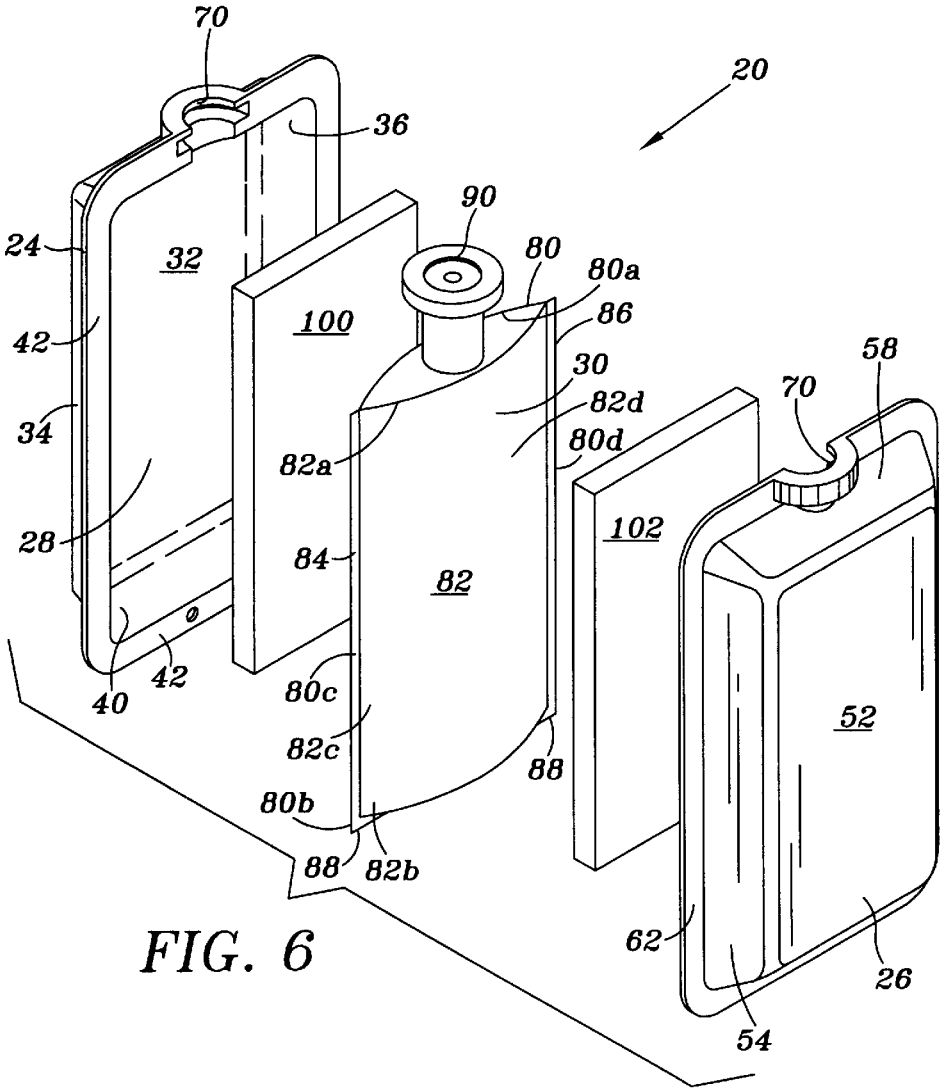
FIG. 6 is an exploded perspective view of the present ink cartridge illustrating one embodiment of the present compressible foam sheets.

Referring simultaneously to FIGS. 1–6, the present ink cartridge is illustrated, and is generally identified by the numeral 20. Ink cartridge 20 includes a housing 22 having housing members 24 and 26. Housing members 24 and 26 are generally symmetrical and are joined together to define a cavity 28 for receiving an ink bag, generally identified by the numeral 30 (FIG. 6).

Housing member 24 includes a side wall 32 having side panels 34 and 36, a top panel 38, and a bottom panel 40 extending therefrom. Extending from side panels 34 and 36, top panel 38, and bottom panel 40 is a flange 42.

Housing member 26 includes a side wall 52 having side panels 54 and 56 extending therefrom. A top panel 58 and bottom panel 60 also extend from side wall 52. Extending from side panels 54 and 56, top panel 58 and bottom panel 60 is a flange 62. Flange 62 mates with flange 42 to form housing 22. Flanges 42 and 62 may be interconnected by ultrasonic welding or other fastening techniques.

Extending from top panels 38 and 58 is an aperture 70 which receives the ink cartridge 20.

Referring to FIG. 6, ink bag 30 includes two layers or walls 80 and 82 of flexible sheet material of similar size and shape, preferably rectangular in form. Wall 80 includes a top 80*a*, bottom 80*b*, and spaced apart sides 80*c* and 80*d*. Wall 82 includes a top 82*a*, bottom 82*b*, and spaced apart sides 8*c* and 82*d*. Sides 80*c* and 82*c* of walls 80 and 82 are sealed to form a seam 84 extending along the length of bag 30. Sides 80*d* and 82*d* are sealed to form a seam 86 extending between the top and bottom of bag 30. Bottom walls 80*b* and 82*b* of walls 80 and 82 are sealed to form a bottom seam 88 for bag 30. In forming seams 84, 86, and 88, heat and pressure is applied to walls 80 and 82 thereby forming bag 30. Bag 30 includes an outlet port 90 which aligns with aperture 70 within housing 22 through which ink is dispensed from ink cartridge 20.

Although bag 30 is illustrated as having a bottom seam, bag 30 can be formed by folding a single sheet of flexible material over itself thereby forming a bottom without the requirement of a seam.

An important aspect of the present invention is the use of compressible foam sheets 100 and 102 which are disposed within cavity 28 of housing 22. Compressible foam sheets 100 and 102 may comprise, for example, elastomers, including polyurethane, polyisoprene, neoprene, silicone, polyvinyl chloride or polyester polymers and blends thereof with other elastomers to form open or closed cell foam that is compressible from a fully compressed configuration and which expand to an uncompressed configuration while ink is being dispensed from ink cartridge 20. Additionally, rubber, felt, or natural sponge can be utilized and are included herein in the meaning of the term "foam sheet". Sheet 100 is disposed adjacent to side wall 32 of housing member 24 and wall 80 of bag 30. Sheet 102 is disposed between side wall 52 of housing member 26 and wall 82 of bag 30. Sheets 100 and 102 are sized to substantially the same size as side wall 32 and side wall 52, respectively, and cover seams 84, 86, and 88 of bag 30 on both sides of walls 80 and 82.

Figure 7:
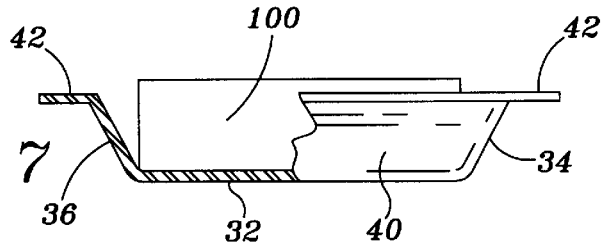
FIG. 7 is a side view, partially in section, illustrating the present foam sheet disposed in the housing.

As illustrated in FIG. 7, sheet 102 as well as sheet 100 have an uncompressed thickness which extends above the flange 42 or 62 of the respective housing member 24 or 26 in an uncompressed configuration. Sheets 100 and 102 completely fill cavity 28 of ink cartridge 20 in an uncompressed configuration. In a compressed configuration sheets 100 and 102 apply a uniform distribution of pressure along seams 84, 86, and 88 to maintain seams 84, 86, and 88 from experiencing excess stress thereby reducing the risk of failure of these seams.

Figure 8:
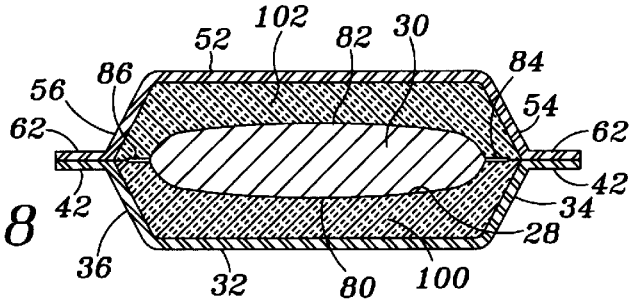
FIG. 8 is a sectional view taken generally along sectional lines 8—8 of FIG. 4 illustrating an ink bag filled with ink.
Figure 9:
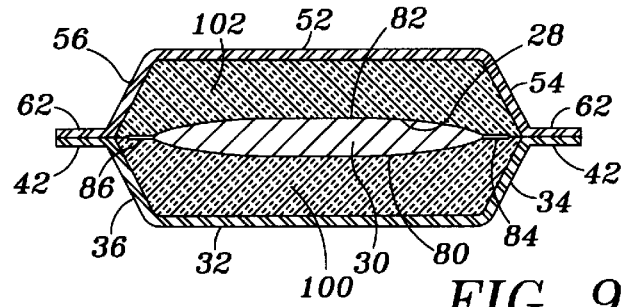
FIG. 9 is a sectional view taken generally along sectional lines 9—9 of FIG. 4 illustrating an ink bag with a partial supply of ink.

Referring now to FIGS. 8 and 9, ink bag 30 is illustrated as being inserted within cavity 28 of housing 22 between sheets 100 and 102. FIG. 8 illustrates ink beg 30 in a full configuration whereas FIG. 9 illustrates ink bag 30 in a near empty configuration. When ink bag 30 is in a full configuration, sheets 100 and 102 are fully compressed within cavity 28 as illustrated in FIG. 8. The natural bias of sheets 100 and 102 is to return to the fully expanded or uncompressed configuration, and as ink is withdrawn from ink bag 30, sheets 100 and 102 expand as illustrated in FIG. 9. This expansion uniformly forces ink from ink bag 30 until ink bag 30 is near or completely empty. Sheets 100 and 102 also maintain a uniform distribution of pressure along seams 84, 86, and 88 as ink is withdrawn from ink bag 30 as well as applying a uniform pressure along walls 80 and 82 as ink is withdrawn from ink bag 30.

Figure 10:
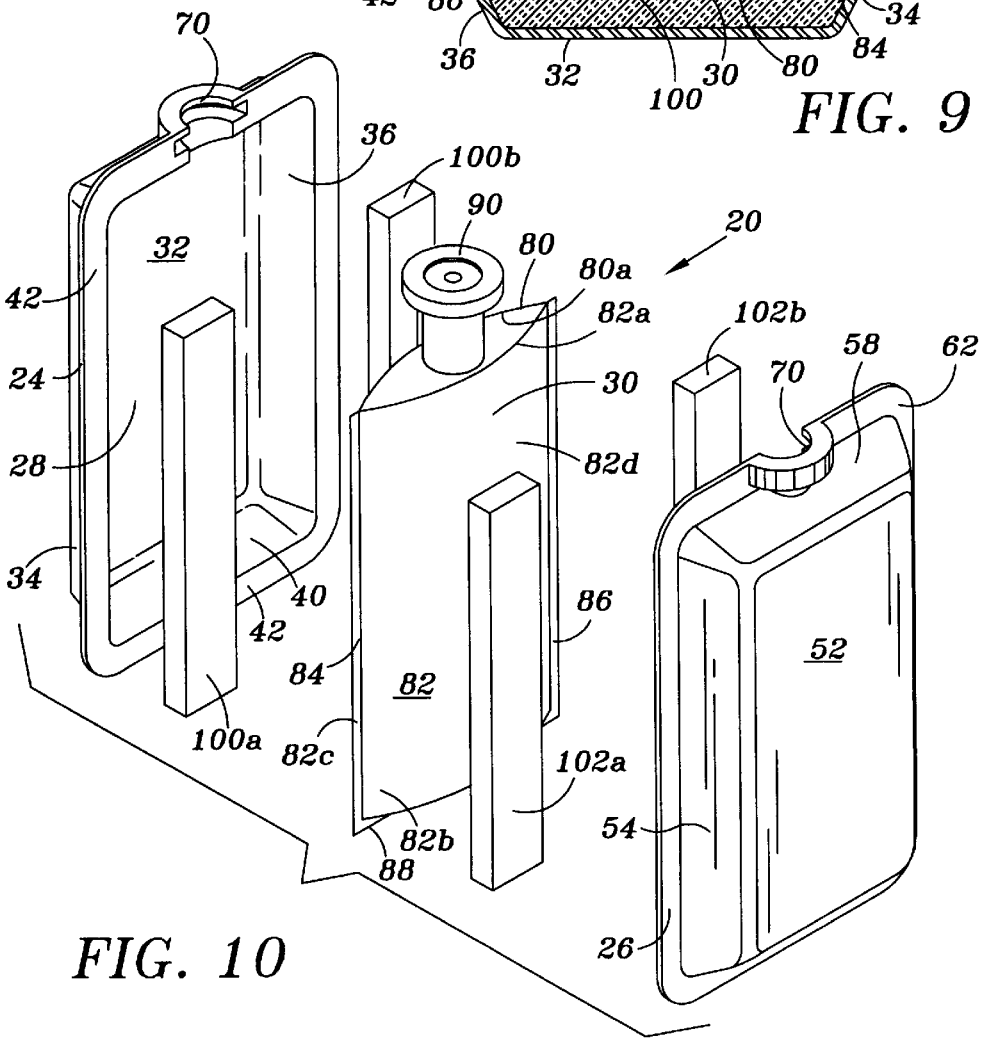
FIG. 10 is an exploded perspective view of the present ink cartridge illustrating an additional embodiment of the present foam sheets.

FIG. 10 illustrates an additional embodiment of the present sheets 100 and 102. Sheet 100 includes strips 100*a* and 100*b* which are disposed adjacent to seams 84 and 86, respectively, of bag 30 adjacent wall 80. Sheet 102 includes strips 102*a* and 102*b* which are disposed along seams 84 and 96, respectively, of bag 30 along wall 82. Strips 100*a*, 100*b*, 102*a*, and 102*b* operate in a manner similar to sheets 100 and 102 for applying a uniform distribution of pressure along seams 84 and 86.

Figure 11:
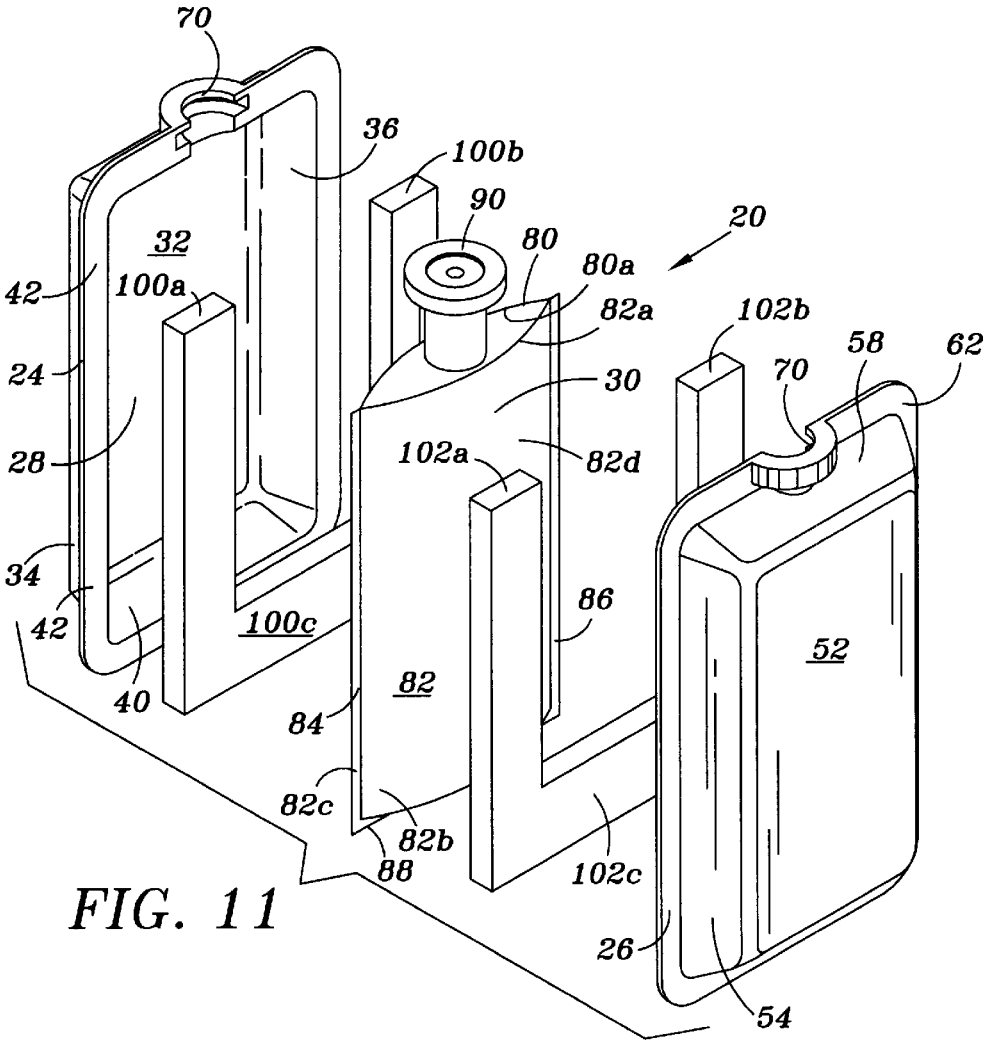
FIG. 11 is an exploded perspective view of the present ink cartridge illustrating an additional embodiment of the present foam sheets.

FIG. 11 illustrates an additional embodiment of the present sheets 100 and 102 as illustrated in FIG. 10 with the addition of a bottom strip 100*c* and 102*c*. Strip 100*c* interconnects strips 100*a* and 100*b*. Strip 102*c* interconnects strips 102*a* and 102*b*. Strips 100*c* and 102*c* apply pressure along seam 88 of bag 30 in a manner similar to that described with respect to sheets 100 and 102.

Figure 12:
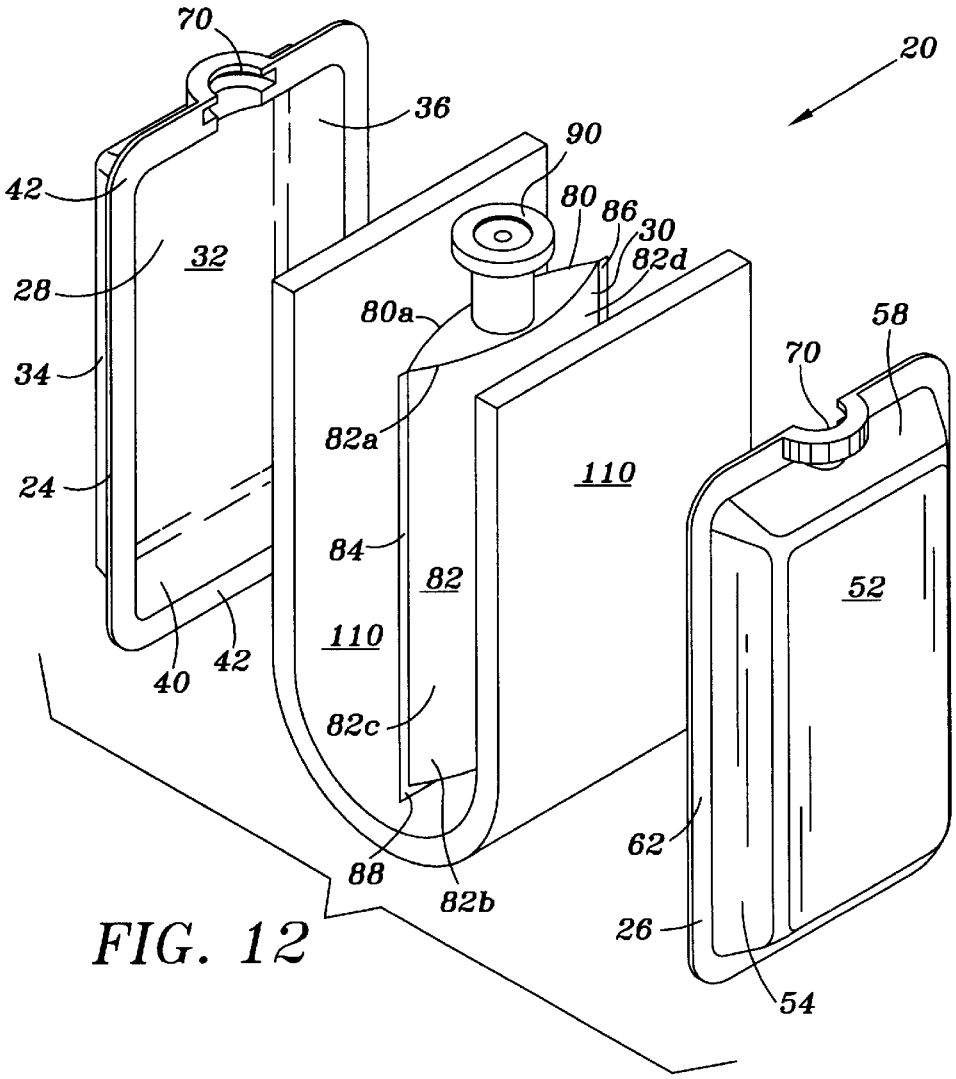
FIG. 12 is an exploded perspective view of the present ink cartridge illustrating an additional embodiment of the present foam sheets.

FIG. 12 illustrates a further embodiment of sheets 100 and 102 similar to the configuration illustrated in FIG. 6; however, sheets 100 and 102 are interconnected into a single sheet 110 having a "U"-shaped configuration. Sheet 110 functions as previously described with respect to sheets 100 and 102.

Figure 13:
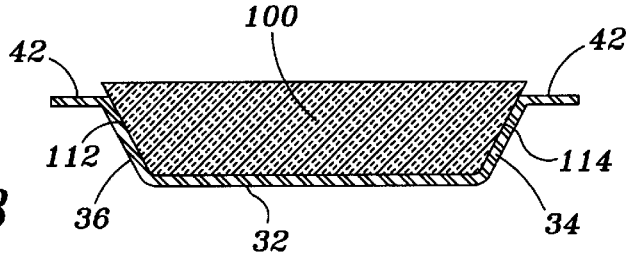
FIG. 13 is an end view of the present ink cartridge illustrating an additional embodiment of a foam sheet.
Figure 14:
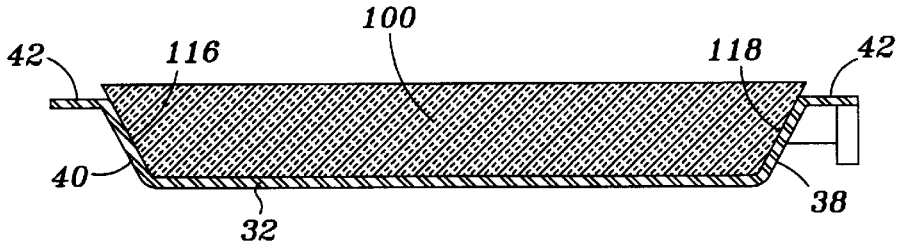
FIG. 14 is a side elevational view of the foam sheet illustrated in FIG. 13.

Referring now to FIGS. 13 and 14, the additional embodiment of sheets 100 and 102 is illustrated. Sheet 100 and 102 as illustrated in FIGS. 6–12 have edges which are generally perpendicularly disposed with respect to the sides of sheets 100 and 102. FIGS. 13 and 14 illustrate a sheet 100 having edges that are angularly disposed to the sides of sheet 100. Edges 112 and 114 are substantially parallel to side panels 34 and 36 of housing member 24. Similarly, edges 116 and 118 (FIG. 14) are substantially parallel to bottom panel 40 and top panel 38, respectively. Sheet 102 is similarly configured with respect to housing member 26.

Sheets 100 and 102 may be permanently affixed to the interior of side walls 32 and 52, respectively, of housing 22 or loosely disposed within cavity 28 of housing 22. In all of the configurations illustrated, sheets 100 and 102 apply, by virtue of their compression forces, a uniform distribution of pressure along the side seams of the ink bag 30. In the embodiments in which sheets 100 and 102 cover the entire walls 80 and 82 of bag 30, sheets 100 and 102 also assist in the uniform dispensing of ink from bag 30 as sheets 100 and 102 expand within cavity 28 of housing 22 as ink is dispensed.

Whereas the present invention has been described with respect to specific embodiments thereof, it will be understood that various changes and modifications will be suggested to one skilled in the art and it is intended to encompass such changes and modifications as fall within the scope of the appended claims.

What is claimed is:

1. An ink cartridge comprising:

an ink bag for containing ink, said bag having front and rear walls, each of said walls having a top, bottom and spaced apart sides, said front and rear walls being sealed together along said bottom to form a bottom seam and sealed together along said sides to form side seams;

a housing having first and second side walls defining a cavity for receiving said bag;

a first compressible foam sheet disposed in said cavity between said first side wall of said housing and said front wall of said bag and adjacent said side seams; and a second compressible foam sheet disposed in said cavity between said second side wall of said housing and to said rear wall of said bag and adjacent said side seams, such that said foam sheets apply a uniform distribution of pressure along said side seams of said bag as ink in withdrawn from said bag.

2. The ink cartridge of claim 1 wherein said first and second compressible foam sheets each include first and second spaced apart strips extending adjacent said bag side seams.

3. The ink cartridge of claim 2 wherein said first and second compressible foam sheets each include a third strip extending adjacent said bag bottom seam.

4. The ink cartridge of claim 1 wherein said first compressible foam sheet substantially covers said front wall of said bag and said second compressible foam sheet substantially covers said rear wall of said bag.

5. The ink cartridge of claim 1 wherein said first and second compressible foam sheets are interconnected.

6. The ink cartridge of claim 1 wherein said first and second compressible foam sheets substantially fill said cavity when said sheets are in an uncompressed configuration and prior to said cavity receiving said bag.

7. The ink cartridge of claim 1 wherein said first and second compressible foam sheets have an uncompressed combined thickness which is greater than a distance between said first and second side walls of said housing, such that said housing compresses said first and second compressible foam sheets prior to said cavity receiving said bag.

8. The ink cartridge of claim 1 wherein each of said compressible foam sheets includes:

a front surface and a rear surface, a top edge, a bottom edge, and parallel spaced apart side edges, said edges being perpendicularly disposed to said front and rear surfaces.

9. The ink cartridge of claim 1 wherein each of said compressible foam sheets includes:

a front surface and a rear surface, a top edge, a bottom edge, and parallel spaced apart side edges, said edges being angularly disposed to said front and rear surfaces.

10. An ink cartridge comprising:

an ink bag for containing ink, said bag having a front wall and a rear wall;

a housing having first and second side walls defining a cavity for receiving said bag;

a first compressible foam sheet attached to said first side wall of said housing and disposed adjacent said front wall of said bag, such that said first compressible foam sheet substantially covers said front wall of said bag; and a second compressible foam sheet attached to said second side wall of said housing and disposed adjacent said rear wall of said bag, such that said second compressible foam sheet substantially covers said rear wall of said bag, whereby said first and second compressible foam sheets expand within said housing to transition said bag from a full configuration to an empty configuration.

11. The ink cartridge of claim 10 wherein said first and second compressible foam sheets substantially fill said cavity when said sheets are in an uncompressed configuration and prior to said cavity receiving said bag.

12. The ink cartridge of claim 10 wherein said first and second compressible foam sheets have an uncompressed combined thickness which is greater than a distance between said first and second side walls of said housing, such that said housing compresses said first and second compressible foam sheets prior to said cavity receiving said bag.

13. The ink cartridge of claim 10 wherein each of said compressible foam sheets includes:

a front surface and a rear surface, a top edge, a bottom edge, and parallel spaced apart side edges, said edges being perpendicularly disposed to said front and rear surfaces.

14. The ink cartridge of claim 10 wherein each of said compressible foam sheets includes:

a front surface and a rear surface, a top edge, a bottom edge, and parallel spaced apart side edges, said edges being angularly disposed to said front and rear surfaces.

15. An ink cartridge having an ink bag, the bag having front and rear walls, each wall having a top, bottom and spaced apart sides, the front and rear walls being sealed together along the bottom to form a bottom seam and sealed together along the sides to form side seams, to form an enclosure for containing ink, the cartridge comprising:

a housing having first and second side walls defining a cavity for receiving the ink bag;

first and second compressible foam strips attached to said first side wall of said housing and adapted to be disposed adjacent the front wall of the ink bag and adjacent the side seams of the ink bag; and third and fourth compressible foam strips attached to said second side wall of said housing and adapted to be disposed adjacent the rear wall of the ink bag and adjacent the side seams of the ink bag, such that when the ink bag is inserted into the cavity, said foam strips apply a uniform distribution of pressure along the side seams of the ink bag.

16. The ink cartridge of claim 15 and further including:

a fifth compressible foam strip attached to said first side wall of said housing and adapted to be disposed adjacent the front wall of the ink bag and adjacent the bottom seam of the ink bag; and a sixth compressible foam strip attached to said second side wall of said housing and adapted to be disposed adjacent the rear wall of the ink bag and adjacent the bottom seam of the ink bag, such that said strips apply a uniform distribution of pressure along the bottom seam of the ink bag.

17. The ink cartridge of claim 15 wherein said first and second compressible foam strips have an uncompressed combined thickness which is greater than a distance between said first and second side walls of said housing, such that said housing compresses said first and second compressible foam strips prior to said cavity receiving the ink bag.

18. The ink cartridge of claim 15 wherein each of said compressible foam strips includes:

a front surface and a rear surface, a top edge, a bottom edge, and parallel spaced apart side edges, said edges being perpendicularly disposed to said front and rear surfaces.

19. The ink cartridge of claim 15 wherein each of said compressible foam strips includes:

a front surface and a rear surface, a top edge, a bottom edge, and parallel spaced apart side edges, said edges being angularly disposed to said front and rear surfaces.

* * * * *